US010041358B2

(12) United States Patent
Propheter-Hinckley et al.

(10) Patent No.: US 10,041,358 B2
(45) Date of Patent: Aug. 7, 2018

(54) GAS TURBINE ENGINE BLADE SQUEALER POCKETS

(71) Applicant: United Technologies Corporation, Hartford, CT (US)

(72) Inventors: Tracy A. Propheter-Hinckley, Manchester, CT (US); San Quach, East Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 297 days.

(21) Appl. No.: 14/696,601

(22) Filed: Apr. 27, 2015

(65) Prior Publication Data

US 2016/0017719 A1 Jan. 21, 2016

Related U.S. Application Data

(60) Provisional application No. 61/990,153, filed on May 8, 2014.

(51) Int. Cl.
*F01D 5/18* (2006.01)
*F01D 5/20* (2006.01)

(52) U.S. Cl.
CPC ..... *F01D 5/187* (2013.01); *F01D 5/20* (2013.01); *F05D 2260/20* (2013.01)

(58) Field of Classification Search
CPC . F01D 5/187; F01D 5/20; F01D 5/141; F01D 5/147; F01D 11/18; F05D 2260/20
USPC ..... 416/92
See application file for complete search history.

(56) References Cited

U.S. PATENT DOCUMENTS

| | | | | |
|---|---|---|---|---|
| 5,183,385 | A | 2/1993 | Lee et al. | |
| 6,672,829 | B1 | 1/2004 | Cherry et al. | |
| 7,584,538 | B2 | 9/2009 | Lee | |
| 8,092,178 | B2 | 1/2012 | Marini et al. | |
| 8,167,572 | B2 | 5/2012 | Tardif et al. | |
| 8,313,287 | B2 | 11/2012 | Little | |
| 8,512,003 | B2 * | 8/2013 | Klasing | F01D 5/20 416/228 |
| 2014/0099193 | A1 * | 4/2014 | Zhang | F01D 5/20 415/178 |

FOREIGN PATENT DOCUMENTS

| | | |
|---|---|---|
| EP | 2716870 | 4/2014 |
| GB | 2105415 | 3/1983 |

OTHER PUBLICATIONS

Extended European Search Report for European Application No. 15165906.7 dated Sep. 18, 2015.

* cited by examiner

*Primary Examiner* — Logan Kraft
*Assistant Examiner* — Peter T Hrubiec
(74) *Attorney, Agent, or Firm* — Carlson, Gaskey & Olds, P.C.

(57) ABSTRACT

A blade for a gas turbine engine includes an airfoil having a tip with a terminal end surface and multiple squealer pockets recessed into the terminal end surface. A method of cooling a blade includes the steps of providing cooling fluid to a first squealer pocket in an airfoil tip, and providing cooling fluid to a second squealer pocket in the airfoil tip in an amount that is different than that provided to the first squealer pocket.

19 Claims, 4 Drawing Sheets

GAS TURBINE ENGINE BLADE SQUEALER POCKETS

CROSS-REFERENCE TO RELATED APPLICATIONS

This application claims priority to U.S. Provisional Application No. 61/990,153, which was filed on May 8, 2014 and is incorporated herein by reference.

STATEMENT REGARDING FEDERALLY SPONSORED RESEARCH OR DEVELOPMENT

This invention was made with government support under Contract No. N68335-13-C-0005, awarded by the Navy. The Government has certain rights in this invention.

BACKGROUND

This disclosure relates to a gas turbine engine blade, and more particularly, to squealer pockets used in the airfoil tip of some such blades.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Blade tip burning is a well-known issue for turbine blades. To that end multiple tip configurations have been tried over the years to avoid tip burning. One common solution is a tip shelf, wherein the pressure side of the tip is recessed to a given depth and height and then cooling holes are drilled in the tip shelf. Another solution involves a single squealer pocket, wherein a recess is provided centrally in a portion of the airfoil tip. Cooling holes may or may not be provided to fluidly connect the squealer pocket to internal cooling passages.

SUMMARY

In one exemplary embodiment, a blade for a gas turbine engine includes an airfoil having a tip with a terminal end surface and multiple squealer pockets recessed into the terminal end surface.

In a further embodiment of the above, the terminal end surface provides a perimeter wall circumscribing the tip. The squealer pockets are arranged interiorly of the perimeter wall.

In a further embodiment of any of the above, the tip includes at least one intermediate wall that interconnects opposing sides of the perimeter wall and separates adjoining squealer pockets.

In a further embodiment of any of the above, the intermediate wall extends in a thickness direction between pressure and suction sides of the airfoil.

In a further embodiment of any of the above, the airfoil includes at least one cooling passage that is arranged interiorly. Cooling holes fluidly connect at least one cooling passage to the squealer pockets.

In a further embodiment of any of the above, the squealer pockets have a depth of at least 20 mils (0.50 mm).

In a further embodiment of any of the above, one of the squealer pockets is arranged near the leading edge.

In a further embodiment of any of the above, one of the squealer pockets has a first depth near the leading edge that is different than a second depth located aftward of the first depth.

In another exemplary embodiment, a gas turbine engine includes compressor and turbine sections. An airfoil is provided in one of the compressor and turbine sections. The airfoil has a tip with a terminal end surface. Multiple squealer pockets are recessed into the terminal end surface.

In a further embodiment of the above, the turbine section includes a turbine blade that has the airfoil.

In a further embodiment of any of the above, the terminal end surface provides a perimeter wall that circumscribes the tip. The squealer pockets are arranged interiorly of the perimeter wall.

In a further embodiment of any of the above, the tip includes at least one intermediate wall that interconnects opposing sides of the perimeter wall and separates adjoining squealer pockets.

In a further embodiment of any of the above, the intermediate wall extends in a thickness direction between pressure and suction sides of the airfoil.

In a further embodiment of any of the above, the airfoil includes at least one cooling passage that is arranged interiorly. Cooling holes fluidly connect at least one cooling passage to the squealer pockets.

In a further embodiment of any of the above, the squealer pockets have a depth of at least 20 mils (0.50 mm).

In a further embodiment of any of the above, one of the squealer pockets is arranged near the leading edge.

In a further embodiment of any of the above, one of the squealer pocket has a first depth near the leading edge that is different than a second depth located aftward of the first depth.

In another exemplary embodiment, a method of cooling a blade includes the steps of providing cooling fluid to a first squealer pocket in an airfoil tip and providing cooling fluid to a second squealer pocket in the airfoil tip in an amount that is different than that provided to the first squealer pocket.

In a further embodiment of any of the above, the first and second squealer pockets are arranged adjacent to one another.

In a further embodiment of any of the above, the first squealer pocket is arranged near an airfoil leading edge.

In a further embodiment of any of the above, the first squealer pocket is provided more cooling fluid than the second squealer pocket.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
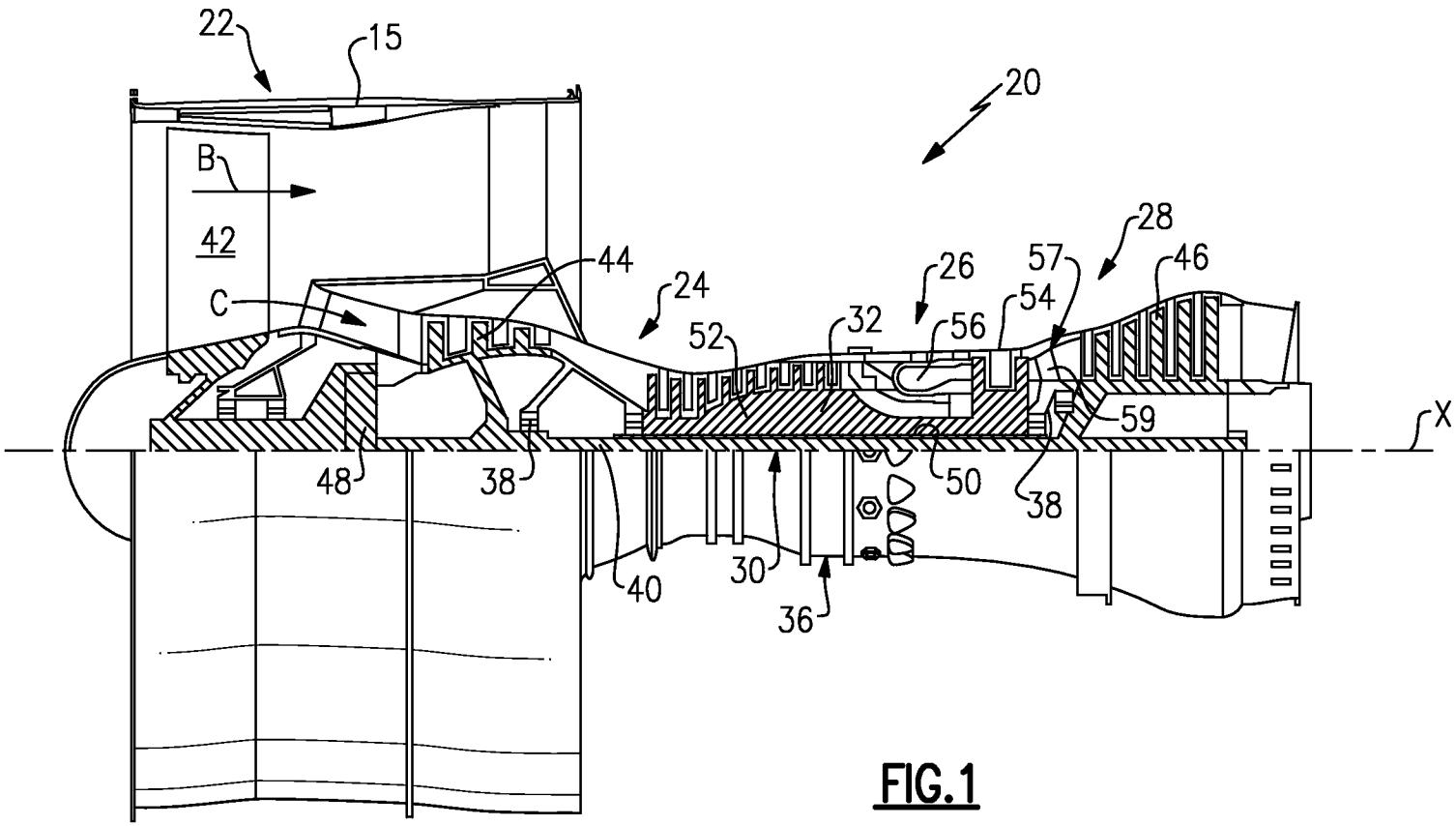
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise. Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figures 2A, 2B:
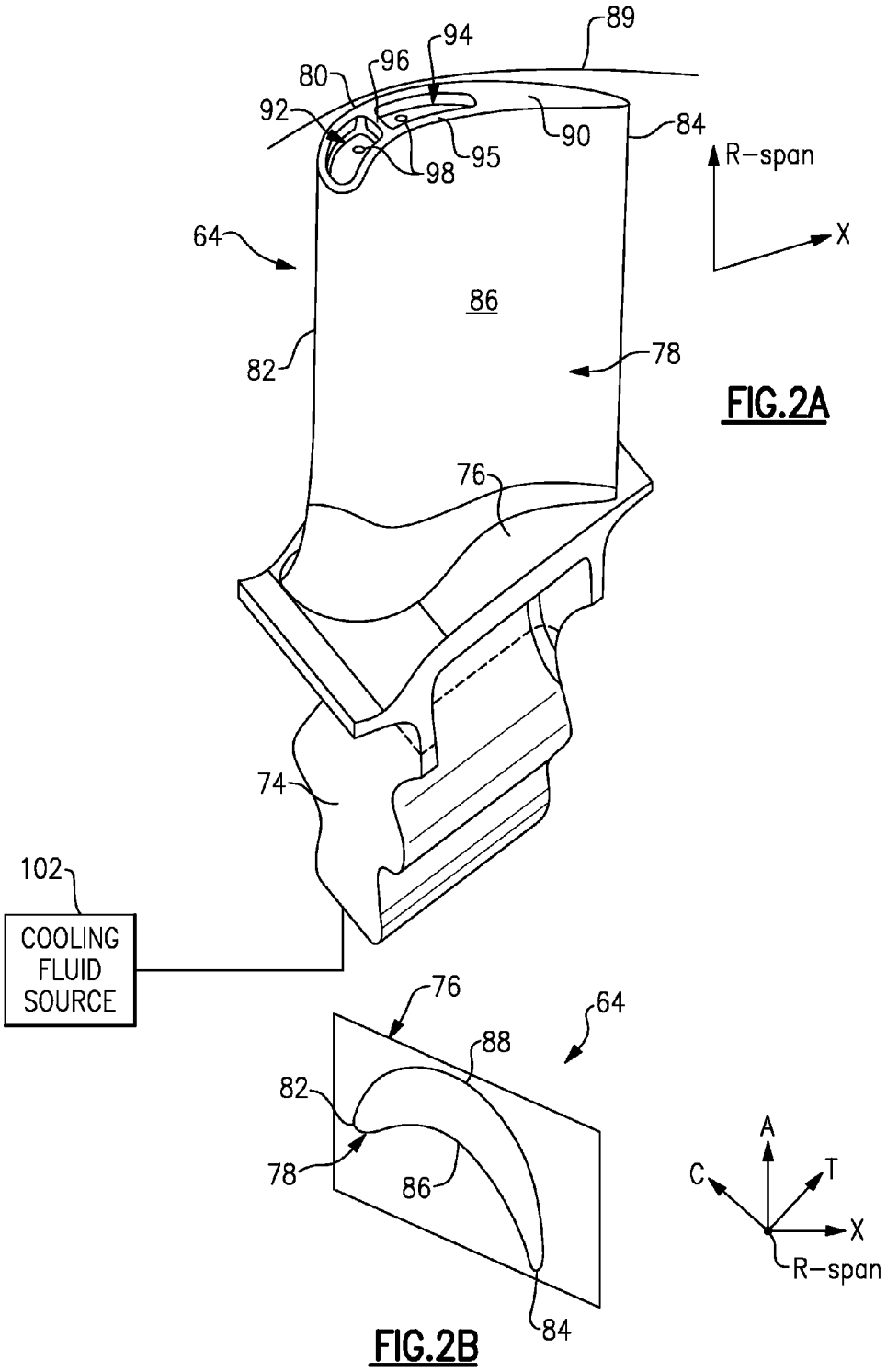
FIG. 2A is a perspective view of the airfoil having the disclosed squealer pockets.
FIG. 2B is a plan view of the airfoil illustrating directional references.

Referring to FIGS. 2A and 2B, a root 74 of each turbine blade 64 is mounted to the rotor disk (not shown). The disclosed airfoil may also be used in a compressor section. The turbine blade 64 includes a platform 76, which provides the inner flow path, supported by the root 74. An airfoil 78 extends in a radial direction R from the platform 76 to a tip 80. It should be understood that the turbine blades may be integrally formed with the rotor such that the roots are eliminated. In such a configuration, the platform is provided by the outer diameter of the rotor. The airfoil 78 provides leading and trailing edges 82, 84. The tip 80 is arranged adjacent to a blade outer air seal 89, which provide the outer flow path.

The airfoil 78 of FIG. 2B somewhat schematically illustrates exterior airfoil surface extending in a chord-wise direction C between a leading edge 82 to a trailing edge 84. The airfoil 78 is provided between pressure (typically concave) and suction (typically convex) wall 86, 88 in an airfoil thickness direction T, which is generally perpendicular to the chord-wise direction C. Multiple turbine blades 64 are arranged circumferentially in a circumferential direction A. The airfoil 78 extends from the platform 76 in the radial direction R, or spanwise, to the tip 80.

The airfoil 78 includes one or more cooling passages provided between the pressure and suction walls 86, 88. The exterior airfoil surface may include multiple film cooling holes (not shown) in fluid communication with the cooling passages. The airfoil 78 may be formed by any suitable process.

Referring to FIG. 2A, the tip 80 of the airfoil 78 includes a terminal end surface 90 that is arranged adjacent to a blade outer air seal 89 during engine operation. Multiple squealer pockets 92, 94 are provided in the terminal end surface 90. In the example, a perimeter wall 95 circumscribes the tip 80. Although two squealer pockets are shown, more than two pockets may be provided in the tip 80. The squealer pockets 92, 94 are arranged interiorly of and surrounded by the perimeter wall 95. An intermediate wall 96 interconnects opposing sides of the perimeter wall 95 to separate the adjoining squealer pockets 92, 94. The intermediate wall 96 extends in the thickness direction T in the example. The airfoil may be provided in the compressor and/or turbine sections.

Figure 3:
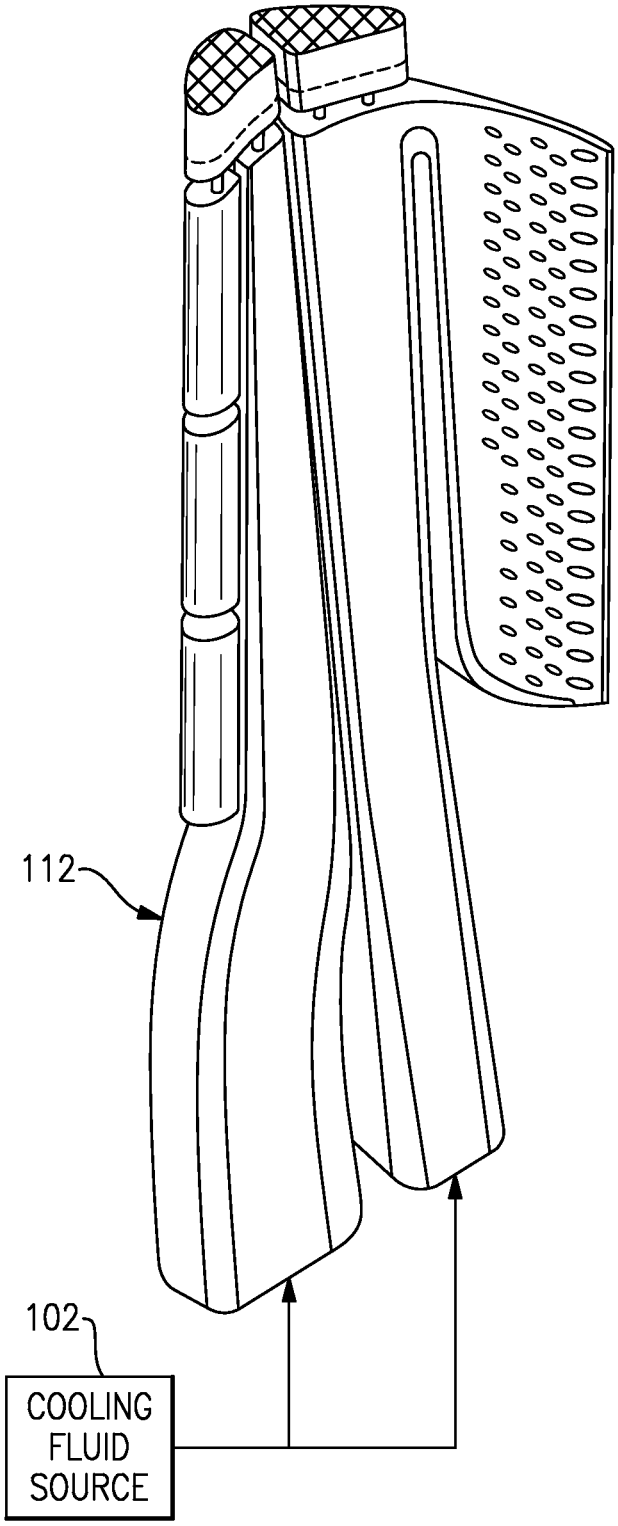
FIG. 3 is a perspective view of a core used to produce correspondingly shaped cooling passages in the airfoil illustrated in FIG. 2A.
Figure 4:
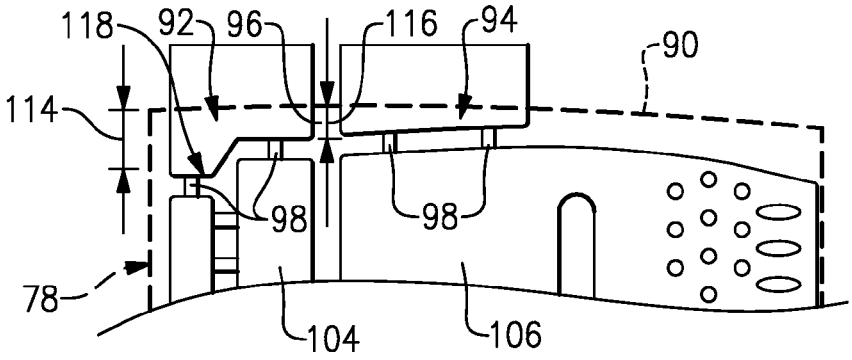
FIG. 4 is a cross-sectional view of one example airfoil with multiple squealer pockets.

Cooling holes 98 fluidly interconnect the squealer pockets 92, 94 to cooling passages arranged internally within the airfoil 78. The cooling passages are formed by a correspondingly shaped core 112, which is shown in FIG. 3. The shaded portion of the core 112 represents a portion that extends beyond the tip 80 during the casting process. The cooling passages formed by this core 112 are supplied a cooling fluid from a cooling source 102, which may be provided by compressor bleed air. Example cooling passages 104, 106 are illustrated in FIG. 4. It should be understood that any suitable configuration of cooling passages may be provided in the airfoil 78 based upon the particular blade application.

In the example, the squealer pockets 92, 94 have a depth of at least 20 mils (0.50 mm). The squealer pockets 92, 94 are arranged in areas of the tip 80 in which a boundary of cooling fluid is desired, such as near the leading edge 82 (e.g., the squealer pocket 92). In the example, the squealer pocket 94 is arranged adjacent to the squealer pocket 92, although the squealer pocket 94 may be spaced from, or remote from, the squealer pocket 92, for example, near the trailing edge 84.

The intermediate wall 96 maintains the cooling fluid within the forward squealer pocket, for example, to prevent migration of the cooling fluid to areas where it is not needed, such as more aftwardly located regions of the tip 80. Other features also may be used to maintain the cooling fluid where desired. For example, referring to FIG. 4, the squealer pocket 92 includes a stepped bottom surface 118 having first and second depths 114, 116. The first depth 114 is larger than the second depth 116 and located near the leading edge to better retain the cooling fluid near the leading edge.

Figure 5:
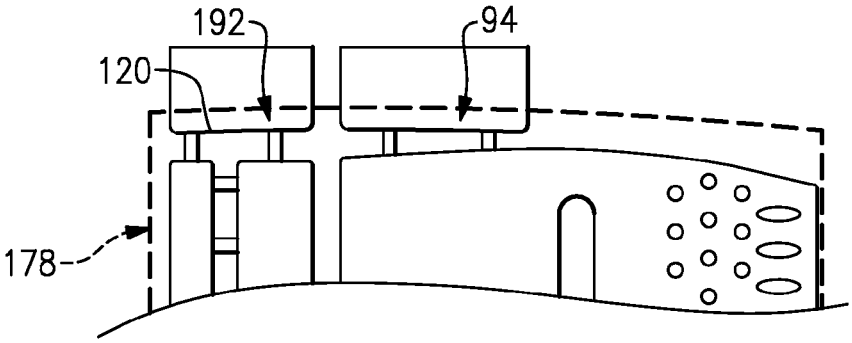
FIG. 5 is a cross-sectional view of another example airfoil with multiple squealer pockets.

Another example squealer pocket configuration 192 of an airfoil 178 is shown in FIG. 5 in which the squealer pocket 192 has a bottom surface 120 that provides a generally uniform depth to the squealer pocket 192. The bottom may be flat or be curved to match the curvature of the blade tip.

Figure 6:
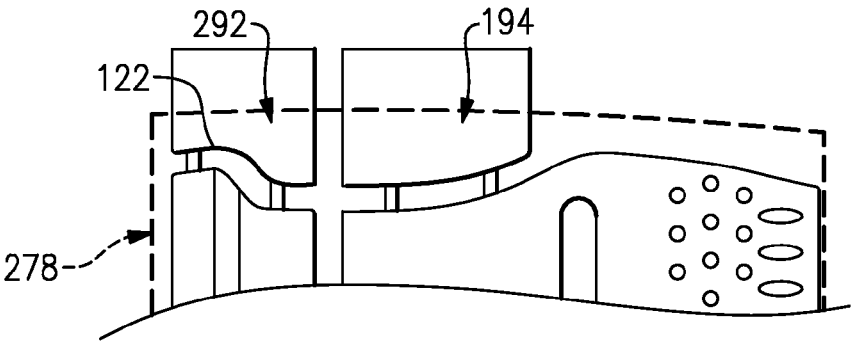
FIG. 6 is a cross-sectional view of still another example airfoil with multiple squealer pockets.

The example airfoil 278 shown in FIG. 6 illustrates a forward sloped surface 122 that provides a decreased depth near the leading edge than a more aftward located portion of the squealer pocket 292. Squealer pockets having geometries other than shown may be used if desired. The squealer pocket 194 may be deeper than the squealer pocket 292, if desired.

A desired amount of cooling fluid is provided to the squealer pocket 92. A different amount of cooling fluid may be provided to the second squealer pocket 94, in one example. Thus, more cooling fluid may be provided to the squealer pocket 92 near the leading edge, for example, where more cooling fluid is typically desired due to the hotter temperatures under which the leading edge operates.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A blade for a gas turbine engine comprising:

an airfoil extending in a radial direction to a tip with a terminal end surface, and multiple squealer pockets recessed into the terminal end surface, wherein one of the squealer pockets has a first depth near the leading edge that is different than a second depth located aftward of the first depth, wherein a continuous perimeter surface is parallel with the radial direction and circumscribes without interruption an entirety of the one of the squealer pockets, and the terminal end surface adjoins the perimeter surface.

2. The blade according to claim 1, wherein the terminal end surface provides a perimeter wall circumscribing the tip, the squealer pockets arranged interiorly of the perimeter wall.

3. The blade according to claim 2, wherein the tip includes at least one intermediate wall interconnecting opposing sides of the perimeter wall and separating adjoining squealer pockets.

4. The blade according to claim 3, wherein the intermediate wall extends in a thickness direction between pressure and suction sides of the airfoil.

5. The blade according to claim 1, wherein the airfoil includes at least one cooling passage arranged interiorly, and cooling holes fluidly connect the at least one cooling passage to the squealer pockets.

6. The blade according to claim 1, wherein the squealer pockets have a depth of at least 20 mils (0.50 mm).

7. The blade according to claim 1, wherein one of the squealer pockets is arranged near the leading edge.

8. A gas turbine engine comprising:

compressor and turbine sections; and an airfoil provided in one of the compressor and turbine sections, the airfoil extending in a radial direction to a tip with a terminal end surface, and multiple squealer pockets recessed into the terminal end surface, wherein one of the squealer pockets has a first depth near the leading edge that is different than a second depth located aftward of the first depth, wherein a continuous perimeter surface extends radially inwardly relative to the terminal end surface about the entire circumference of the one of the squealer pockets and without interruption, and the terminal end surface adjoins the perimeter surface.

9. The gas turbine engine according to claim 8, wherein the turbine section includes a turbine blade having the airfoil.

10. The gas turbine engine according to claim 8, wherein the terminal end surface provides a perimeter wall circumscribing the tip, the squealer pockets arranged interiorly of the perimeter wall.

11. The gas turbine engine according to claim 10, wherein the tip includes at least one intermediate wall interconnecting opposing sides of the perimeter wall and separating adjoining squealer pockets.

12. The gas turbine engine according to claim 11, wherein the intermediate wall extends in a thickness direction between pressure and suction sides of the airfoil.

13. The gas turbine engine according to claim 8, wherein the airfoil includes at least one cooling passage arranged interiorly, and cooling holes fluidly connect the at least one cooling passage to the squealer pockets.

14. The gas turbine engine according to claim 8, wherein the squealer pockets have a depth of at least 20 mils (0.50 mm).

15. The gas turbine engine according to claim 8, wherein one of the squealer pockets is arranged near the leading edge.

16. A method of cooling a blade comprising the steps of:

providing cooling fluid to a first squealer pocket in an airfoil tip; and providing cooling fluid to a second squealer pocket in the airfoil tip in an amount that is different than that provided to the first squealer pocket, wherein one of the first and second squealer pockets includes a stepped bottom surface, wherein a continuous perimeter surface is parallel with a radial direction of the blade and circumscribes without interruption an entirety of the one of the first and second squealer pockets, and a terminal end surface of the airfoil tip adjoins the perimeter surface.

17. The method according to claim 16, wherein the first and second squealer pockets are arranged adjacent to one another.

18. The method according to claim 16, wherein the first squealer pocket is arranged near an airfoil leading edge.

19. The method according to claim 18, wherein the first squealer pocket is provided more cooling fluid than the second squealer pocket.

* * * * *